US010938140B2

(12) United States Patent
Enomoto et al.

(10) Patent No.: US 10,938,140 B2
(45) Date of Patent: Mar. 2, 2021

(54) CONNECTOR

(71) Applicant: NIPPON TANSHI CO., LTD., Kanagawa (JP)

(72) Inventors: Shinya Enomoto, Kanagawa (JP); Osamu Nishimura, Kanagawa (JP)

(73) Assignee: NIPPON TANSHI CO., LTD., Kanagawa (JP)

( * ) Notice: Subject to any disclaimer, the term of this patent is extended or adjusted under 35 U.S.C. 154(b) by 217 days.

(21) Appl. No.: 16/302,175

(22) PCT Filed: May 11, 2017

(86) PCT No.: PCT/JP2017/017865

§ 371 (c)(1),
(2) Date: Nov. 16, 2018

(87) PCT Pub. No.: WO2017/199847

PCT Pub. Date: Nov. 23, 2017

(65) Prior Publication Data

US 2020/0321721 A1 Oct. 8, 2020

(30) Foreign Application Priority Data

May 18, 2016 (JP) ..... JP2016-099780

(51) Int. Cl.
*H01R 13/436* (2006.01)
*H01R 13/422* (2006.01)
(Continued)

(52) U.S. Cl.
CPC ..... *H01R 13/4367* (2013.01); *H01R 13/4223* (2013.01); *H01R 13/5219* (2013.01); *H01R 13/62927* (2013.01)

(58) Field of Classification Search
CPC ..... H01R 13/4367; H01R 13/4223; H01R 13/5219
(Continued)

(56) References Cited

U.S. PATENT DOCUMENTS 6,358,102 B1 * 3/2002 Fukamachi ..... H01R 13/4362 439/752
7,488,221 B2 * 2/2009 Tanaka ..... H01R 13/4223 439/752
(Continued)

FOREIGN PATENT DOCUMENTS

CN 205081323 3/2016
EP 1109263 6/2001
(Continued)

OTHER PUBLICATIONS

Chinese Office action for CN2017800306540 dated Dec. 20, 2019, 6 pages.
(Continued)

*Primary Examiner* — Alexander Gilman
(74) *Attorney, Agent, or Firm* — Dority & Manning, P.A.

(57) ABSTRACT

In order to eliminate the need to provide a connector including a side retainer with an additional waterproof seal for the side retainer, the connector includes a terminal holder in which the side retainer is mounted, and the terminal holder is configured to define access passages such that a tool for moving the side retainer between first and second positions can be inserted into an inlet of the terminal holder so as to reach inclined cam surfaces of the side retainer and move the side retainer.

5 Claims, 16 Drawing Sheets

(51) Int. Cl.
*H01R 13/52* (2006.01)
*H01R 13/629* (2006.01)

(58) Field of Classification Search
IPC ..... H01R 13/43
See application file for complete search history.

(56) References Cited

U.S. PATENT DOCUMENTS

| | | | | |
|---|---|---|---|---|
| 7,500,887 | B2 * | 3/2009 | Ichio | H01R 13/4362 439/595 |
| 7,695,325 | B2 * | 4/2010 | Asari | H01R 13/4368 439/752 |
| 7,775,831 | B2 * | 8/2010 | Mase | H01R 13/4362 439/595 |
| 8,215,987 | B2 * | 7/2012 | Yoshioka | H01R 13/4362 439/587 |
| 8,419,485 | B2 * | 4/2013 | Stausser | H01R 13/4362 439/752 |
| 8,550,845 | B1 * | 10/2013 | Osterhart | H01R 13/4362 439/595 |
| 8,795,000 | B2 * | 8/2014 | Sugimoto | H01R 13/4364 439/595 |
| 9,281,600 | B2 * | 3/2016 | Hirano | H01R 13/4362 |
| 10,622,746 | B2 * | 4/2020 | Abraham | H01R 13/4362 |
| 2009/0191747 | A1 * | 7/2009 | Tanaka | H01R 13/4365 439/352 |
| 2011/0217859 | A1 * | 9/2011 | Kimura | H01R 13/52 439/271 |
| 2014/0120759 | A1 * | 5/2014 | Suzuki | H01R 13/4223 439/345 |
| 2014/0120762 | A1 * | 5/2014 | Kuroda | H01R 13/4223 439/370 |

FOREIGN PATENT DOCUMENTS

| | | |
|---|---|---|
| JP | H11233186 | 8/1999 |
| JP | 2000091023 | 3/2000 |
| JP | 2002324617 | 11/2002 |
| JP | 2006190696 | 7/2006 |
| JP | 2009070572 | 4/2009 |
| JP | 2011187204 | 9/2011 |
| JP | 2012003871 | 1/2012 |
| JP | 2014089885 | 5/2014 |

OTHER PUBLICATIONS

European Search Report for EP17799271.6 dated Dec. 2, 2019, 28 pages.
International Search Report for PCT/JP2017/017865 dated Jul. 12, 2017, 4 pages.

* cited by examiner 10
12
12A
30
32
92
18
14B
74
76
80
78
90
48
96
52
40
42
94
14A
14
20B
98
20A
20
up
rear
right
left
front
down

CONNECTOR

CROSS REFERENCE TO RELATED APPLICATIONS

This application is the U.S. National Stave entry of International Application Number PCT/JP2017/017865 filed under the Patent Cooperation Treaty having a filing date of May 11, 2017, which claims priority to Japanese Patent Application No. 2016-099780 having a filing date of May 18, 2016, which are incorporated herein by reference.

TECHNICAL FIELD

The present invention relates to a connector, in particular to a connector including a retainer structure for locking a terminal.

BACKGROUND ART

A connector includes a terminal holder (inner housing) defining a terminal chamber and a terminal which is to be held in the terminal holder so that the terminal is located in the terminal chamber. Such a connector prevents a terminal from coming off from a terminal holder by using a retaining structure together with a front retainer or side retainer, the retaining structure including a lance locking structure in which a lance portion (a cantilever portion with a locking claw in its tip part) formed on the terminal holder is capable of engaging with a lance engagement recess formed in the terminal (Patent Documents 1 to 3, for example).

The front retainer is configured to be inserted into the terminal holder through an inlet opening formed in the terminal holder such that a connectee member (a member to be connected to the connector), e.g. as a connection partner connector or an edge of a substrate provided with terminals, can be inserted into the terminal chamber, and to abut the lance portion, pushing it into the lance engagement recess.

The side retainer is configured to be inserted into the terminal holder through the opening formed in a side part of the terminal holder, and to engage directly with a stepped portion (a shoulder) formed in the terminal so as to prevent the terminal from coming off.

PRIOR ART DOCUMENT(S)

Patent Document(S)

Patent Document 1: JP2000-091023A
Patent Document 2: JP2009-070572A
Patent Document 3: JP2002-324617

SUMMARY OF THE INVENTION

Task to be Accomplished by the Invention

Since the front retainer is inserted into the terminal holder through the inlet opening of the connectee member, in order to configure the connector to be a waterproof connector, providing the connector with a waterproof seal is sufficient to achieve waterproofing with the connectee member, which means that a separate waterproof seal for the front retainer is not necessary. However, it is only the lance portion itself that prevents the lance portion from deflecting out of the lance engagement recess against an extracting force (pulling force) exerted to the terminal. As a result, in the front retainer, a holding capability (retaining capability) of the connector, an ability of the connector to keep the terminal being held by the terminal holder, depends only on the strength of the lance portion, which makes it difficult to achieve a high holding capability.

Since the side retainer engages directly with the stepped portion of the terminal to prevent the terminal from coming off, a holding capability (retaining capability) of the connector, an ability to keep the terminal being held by the terminal holder, is high. However, because an opening for insertion of the side retainer is inevitably formed on a side of the terminal holder, it becomes necessary to provide an additional waterproof seal on the side part of the terminal holder at the opening for the insertion of the side retainer, in addition to the waterproof seal, in order to achieve waterproofing with the connectee member, which means that the number of necessary waterproof seals disadvantageously increases.

A primary object of the present invention is to eliminate the need to provide a connector provided with a side retainer with an additional dedicated waterproof seal for the side retainer.

Means to Accomplish the Task

In accordance with one embodiment of the present invention, a connector includes: a terminal holder (14) having an inlet (40) on a first side for a connectee member, the terminal holder defining a terminal chamber (42) continuous to the inlet (40) and a terminal introduction passage (46) in communication with the terminal chamber and extending from a second side remote from the first side of the terminal holder; at least one terminal (16) attached to the terminal holder (14) so as to be located in the terminal chamber (42); and a side retainer (18) mounted in the terminal holder (14) in such a manner as to be movable between a first position and a second position spaced apart from the first position in a direction transverse to the terminal introduction passage (46), wherein the side retainer (18) includes at least one locking protrusion (74) configured such that, when the side retainer is at the first position, the at least one locking protrusion is in alignment with the terminal introduction passage (46) and prevents the at least one terminal (16) from coming off, and that, when the side retainer is at the second position, the at least one locking protrusion is offset from the terminal introduction passage (46) so as to allow the at least one terminal (16) to pass through the terminal introduction passage (46) to be placed in the terminal chamber (42), and wherein the terminal holder (14) defines an access passage (96, 98) configured to allow a tool (130) to be inserted into the inlet (40) so as to reach a part of the side retainer (18) and move the side retainer (18) between the first and second positions.

In this configuration, since the side retainer (18) can be manipulated from the side of the inlet (40) to move between a lock position and an unlock position by using the tool (13) inserted into the inlet (40) to reach the side retainer through the access passage (96, 98), there is no need to form any opening on a side of the terminal holder (14) for inserting the tool to manipulate the side retainer (18), thereby eliminating the need to provide the connector with an additional waterproof seal for the side retainer (18).

In the above-described connector, the connector preferably includes an outer shell (12) defining a holder chamber (34) configured to accommodate the terminal holder; and an annular seal (20) attached to the outer shell (12) to provide a waterproof seal between the connectee member (104) and the outer shell (12).

In this configuration, the mere addition of the outer shell (12) and the seal (20) provides a waterproof connector.

In the above-described connector, preferably, the terminal (16) includes a plurality of terminals arranged side by side at regular intervals and in alignment with each other in an alignment direction, and the side retainer includes a strip plate portion (73) having a longitudinal axis extending in the alignment direction of the plurality of terminals, and the at least one locking protrusion (74) includes two or more locking protrusions (16) such that each of the plurality of terminals has one corresponding locking protrusion, and the locking protrusions (74) are formed on a plate surface of the strip plate portion (73) at the same regular intervals as those at which the terminals (16) are arranged.

In this configuration, the connector is made to be a multiple connector by providing the connector with the multiple terminals (16) and the multiple locking protrusions (74).

In the above-described connector, the side retainer (18) preferably has a retainer manipulation portion (92, 94) including an inclined cam surface (92A, 94A), the inclined cam surface being configured to convert a displacement of the tool (130) in a direction in which the access passage (96, 98) extends to a movement of the side retainer in a direction traversing the terminal introduction passage, and wherein the access passage (96, 98) extends to provide an access to the inclined cam surface (92A, 94A).

In this configuration, the connector can be structurally simple because the side retainer (18) is made to be movable from or to the lock position or the unlock position through the manipulation from the side of the inlet (40) only by providing the side retainer (18) with the inclined cam surfaces (92A, 94A) on the both sides and using the simple tool (130) for manipulation.

In the above-described connector, preferably, one of the side retainer (18) and the terminal holder (14) has a projection (88) formed thereon and the other of the side retainer (18) and the terminal holder (14) has a recess (78, 80) formed thereon, the recess and the projection being configured to engage with each other when the side retainer (18) is at the first position or the second position.

In this configuration, the connector is made to include a click stop mechanism, which enables the side retainer (18) to stably maintain its position when the side retainer (18) is at the lock position or the unlock position.

In the above-described connector, preferably, the side retainer (18) includes a fool proofing part (90) configured such that, when the side retainer (18) is at the second position, the fool proofing part (90) is capable of interfering with the connectee member (100) to prevent the connectee member (100) from entering the terminal chamber (42), and that, when the side retainer is at the first position, the fool proofing part (90) allows the connectee member (100) to enter the terminal chamber (42) without interfering with the terminal edge portion (100).

In this configuration, when the side retainer (18) is in the unlock position and thus does not prevent the terminal (16) from coming off, the terminal edge portion (100) is prevented from entering the terminal chamber (42) from the inlet (40), which means that the connectee member is prevented from connecting to the connector under inappropriate conditions for connection.

Effect of the Invention

According to the present invention, a connector provided with a side retainer is not required to have an opening formed on a side of a terminal holder for the insertion and manipulation of a side retainer, which thereby eliminates the need to provide an additional waterproof seal for the side retainer.

DESCRIPTION OF THE PREFERRED EMBODIMENT(S)

Figure 1:
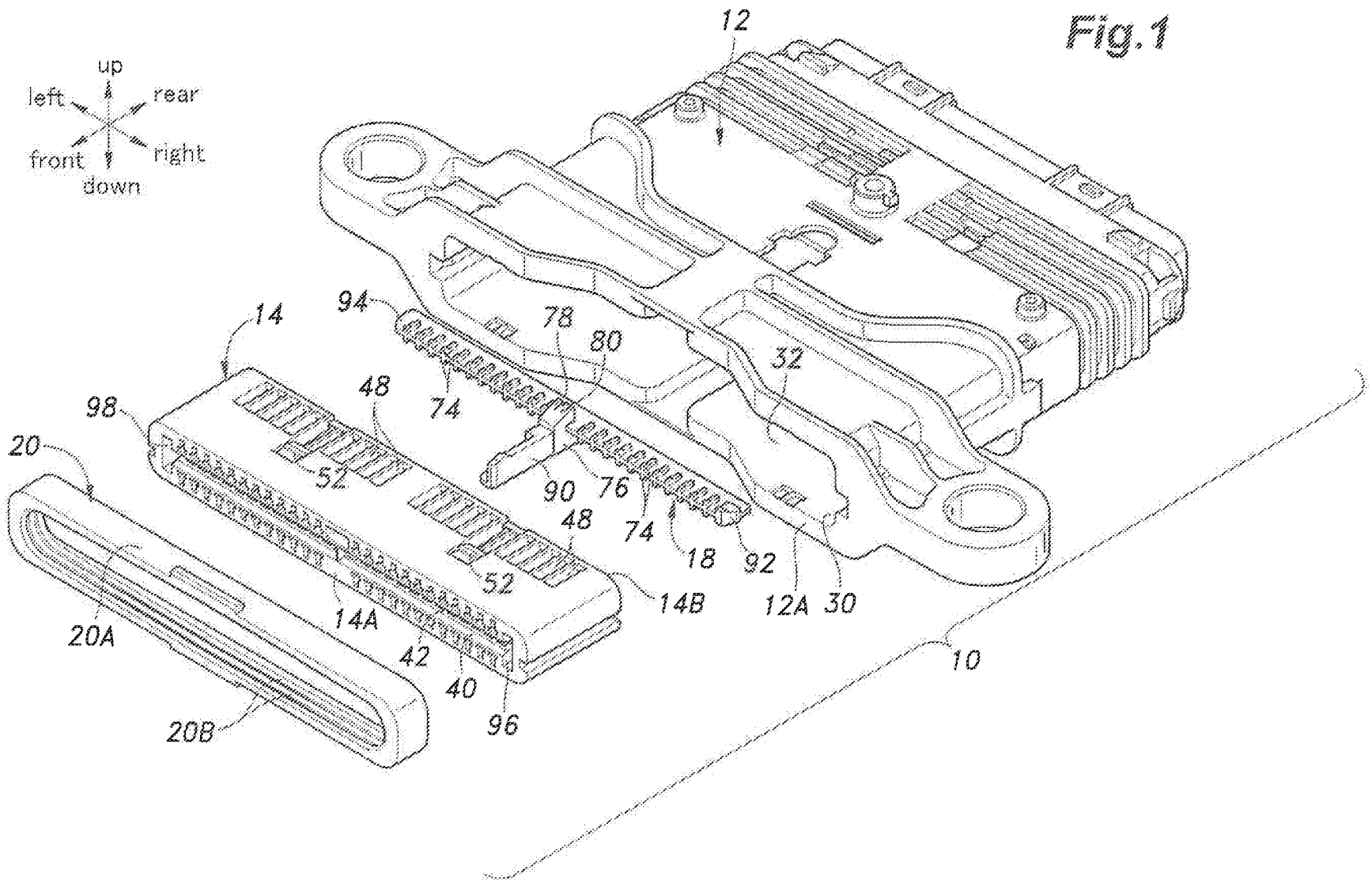
FIG. 1 is an exploded front perspective view of a connector according to one embodiment of the present invention.

An embodiment of the present invention is described in the following with reference to the appended drawings, FIGS. 1 to 16. In each figure, the directions of up and down, front and rear, and right and left are defined as directions indicated by arrows.

A connector 10 of the present embodiment is a waterproof double-sided card edge connector, and includes an outer shell (outer housing) 12, a terminal holder 14, terminals 16, a side retainer 18, a waterproof seal 20, and a cable seal 120 as shown in FIGS. 1 to 6.

The outer shell 12 is a resin molded part, which defines a case receiving chamber 32 with a case inlet 30 opening on one side (front face 12A) for receiving a connectee member (a member to be connected to the connector), and a holder chamber 34 configured to accommodate the terminal holder 14. In the present embodiment, the connectee member is a controller unit 104 with a terminal edge portion 100 of a double-sided printed board which protrudes outward from a flat box-shaped packaging case 102 (see FIGS. 15 and 16).

The terminal holder 14 is a resin molded part, which defines a slit-shaped edge inlet 40 opening on one side (front face 14A) for receiving the terminal edge portion 100 and a terminal chamber 42 which is contiguous with the edge inlet 40 so as to accommodate the inserted terminal edge portion 100.

As shown in FIGS. 2 to 7, the terminal chamber 42 includes terminal retention recesses 44 formed on the upper and lower sides and extending in the front and rear direction such that the terminal retention recesses 44 are arranged at equal intervals in the left and right direction. The terminal holder 14 has, for each terminal holding recess 44, a terminal introduction passage 46 extending in the front and rear direction from a rear face 14B to the terminal holding recess 44. In other words, in each of the upper and the lower walls of the terminal holder 14, the terminal holding recesses 44 and the terminal introduction passages 46 are formed at equal intervals in the left and right direction. Furthermore, rectangular openings 48 extending in the front and rear direction are defined in the upper and the lower walls of the terminal holder 14 for the respective terminal holding recesses 44, where each rectangular opening has a lance portion (locking piece) 50 integrally formed therewith, the lance portion having a cantilever portion extending frontward from the rear wall of each opening 48 and a claw formed on the cantilever portion.

The terminal holder 14 is configured to be inserted into the holder chamber 34 from the case inlet 30 until the rear face 14B comes in contact with the inner-rear face 12B (FIG. 6) of the holder chamber 34, and secured to the outer shell 12 by locking claws 52 formed on the upper and lower surfaces thereof in engagement with recesses (not shown) formed on the outer shell 12.

Figure 4:
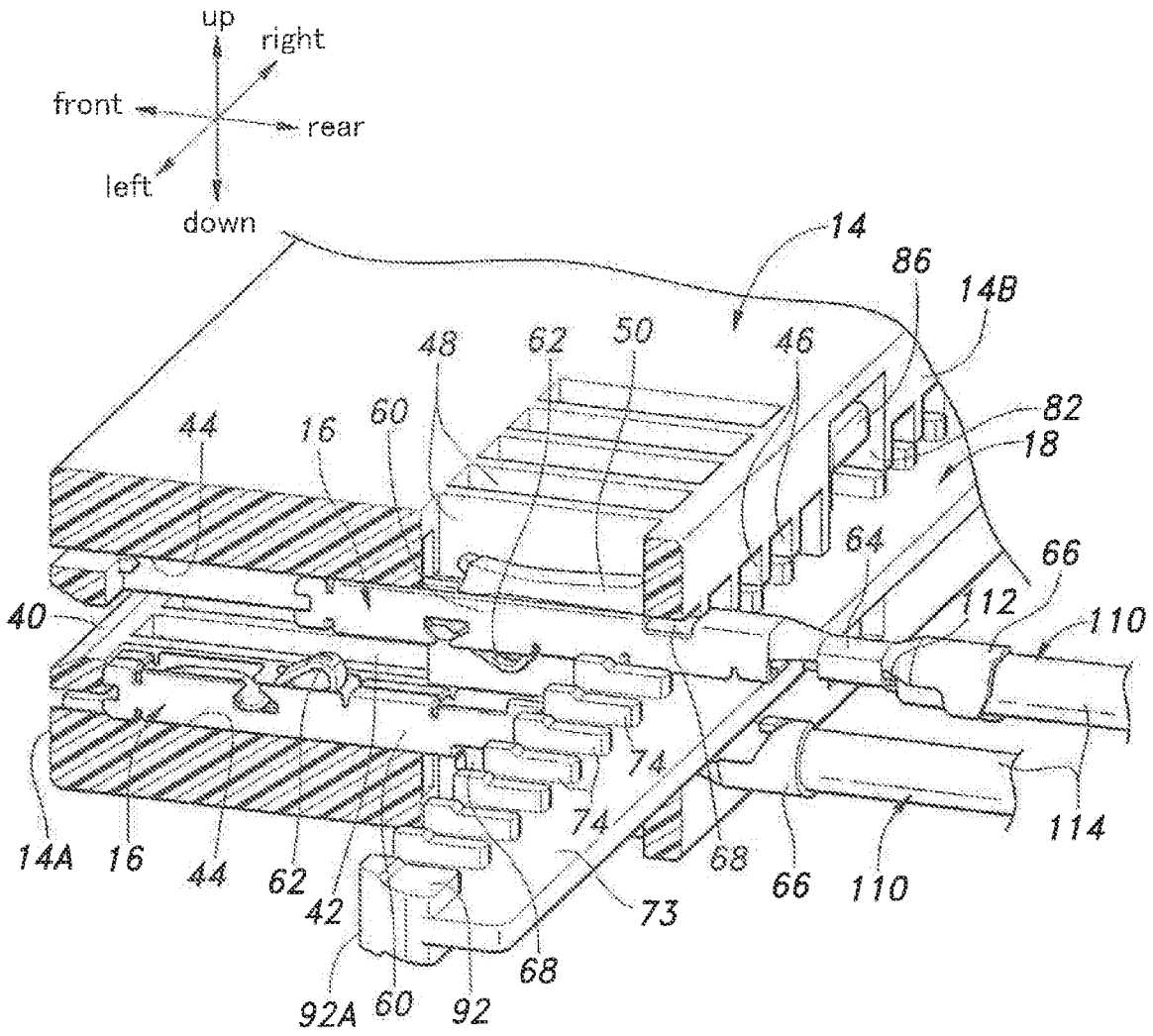
FIG. 4 is a partially cross-sectional enlarged perspective view of the connector according to the embodiment of the present invention, illustrating the side retainer of the connector located at a first position.
Figure 5:
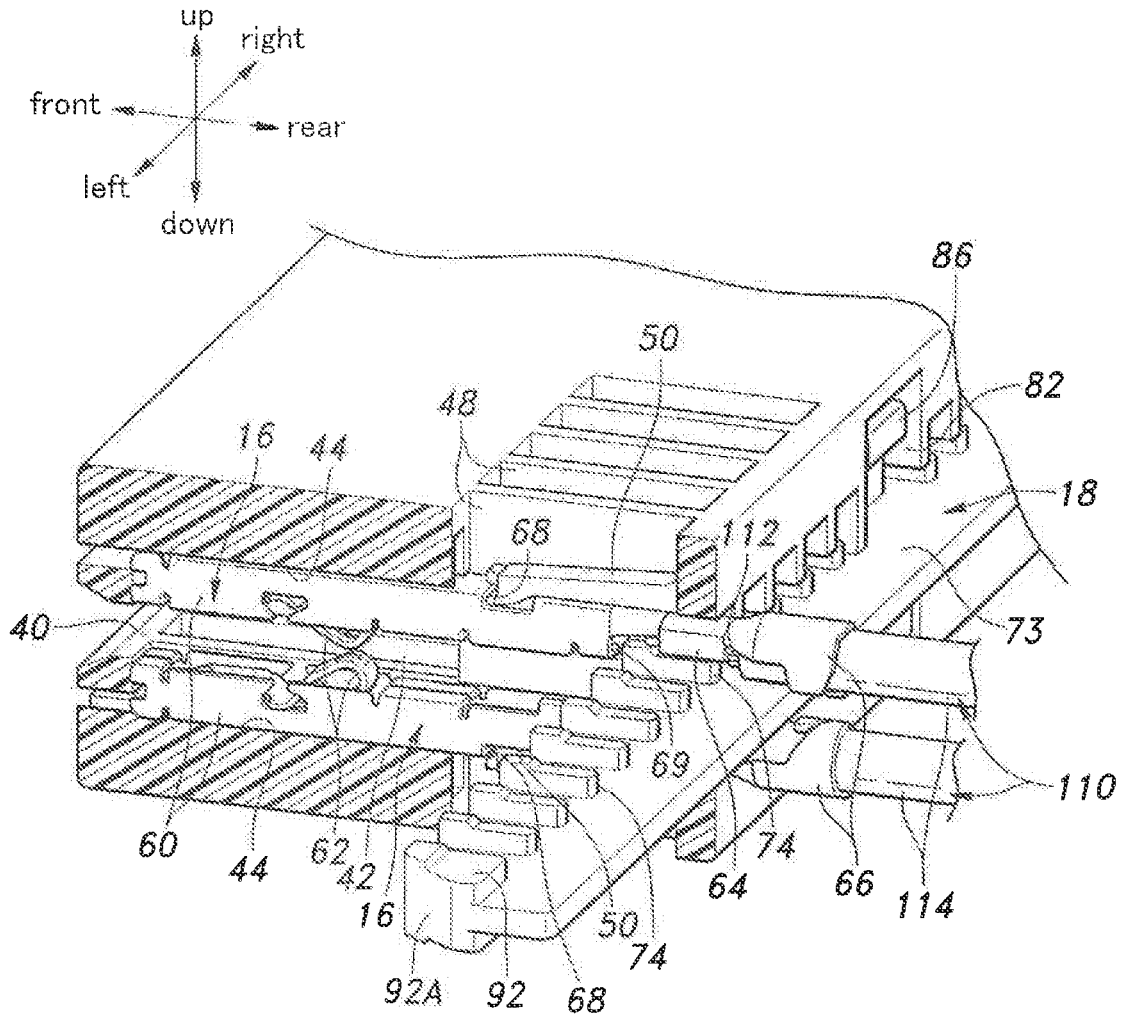
FIG. 5 is a partially cross-sectional enlarged perspective view of the connector according to the embodiment of the present invention, illustrating the side retainer of the connector located at a second position.
Figure 6:
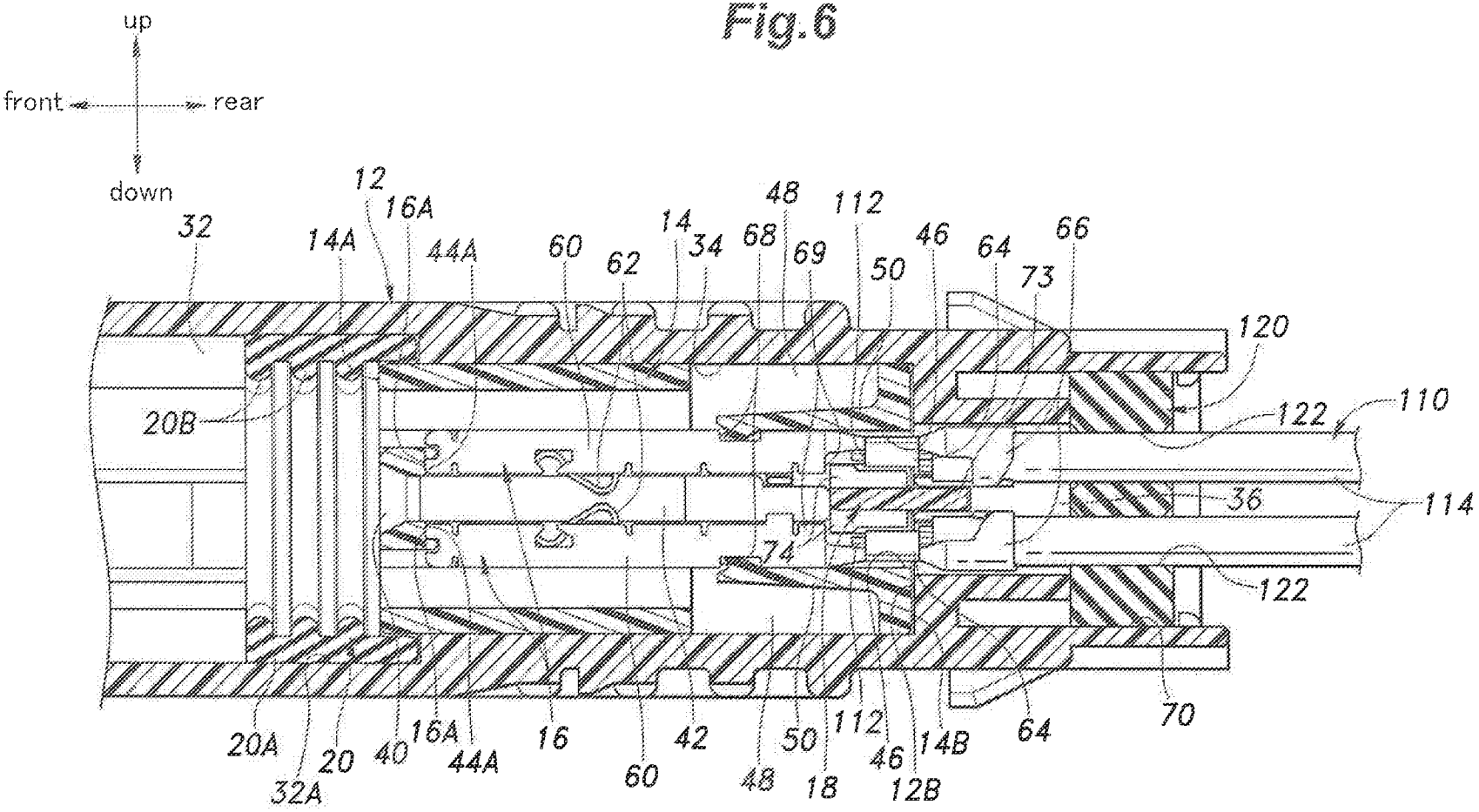
FIG. 6 is an enlarged longitudinal cross-sectional view of the connector.
Figure 7:
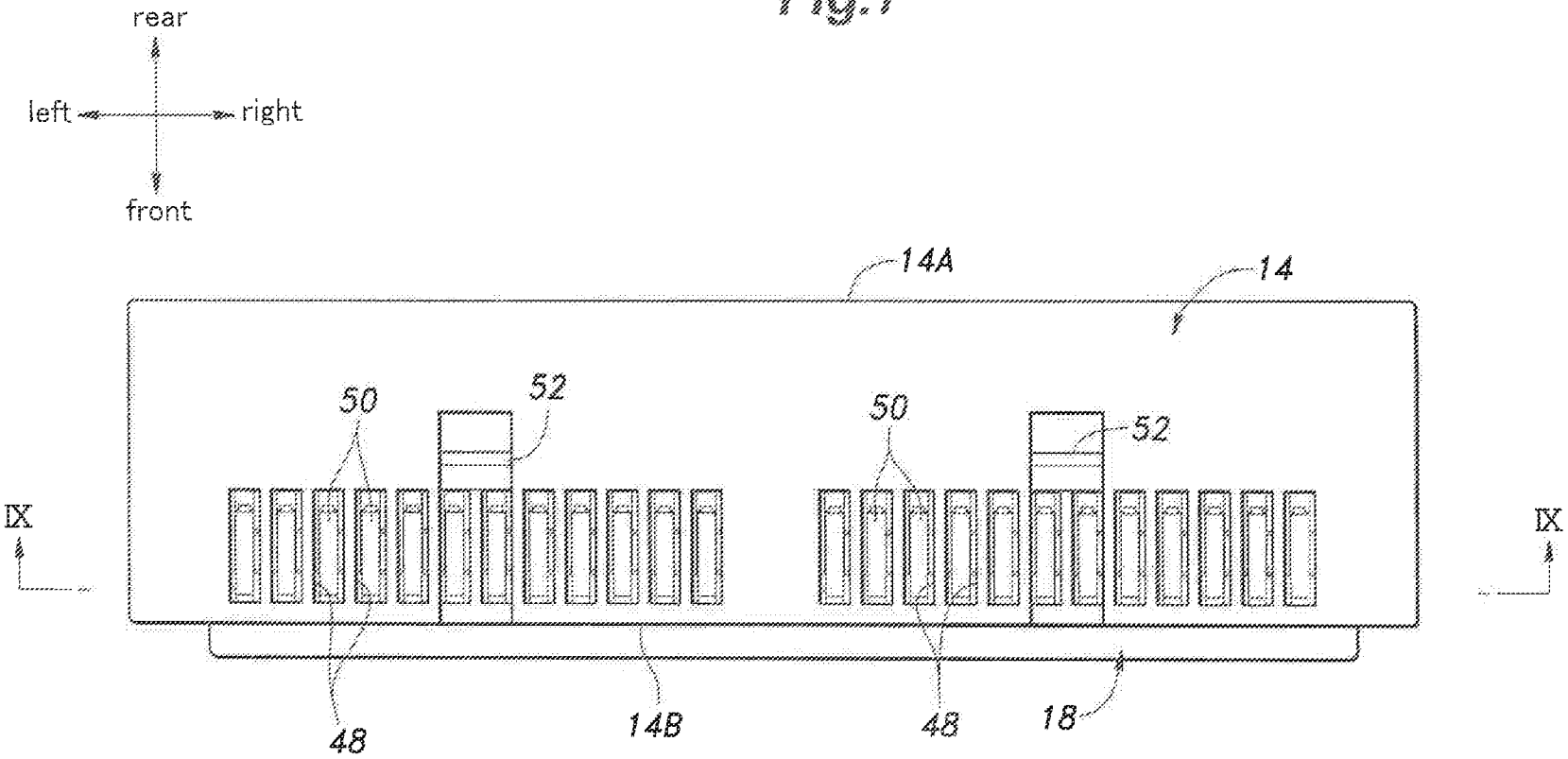
FIG. 7 is a plan view of the terminal holder and the side retainer of the connector according to the embodiment of the present invention.

As shown in FIGS. 4 to 6, each terminal 16 is an elongated female crimp terminal having a terminal body 60 which is formed by bending a metal plate so as to have a groove-shaped cross-sectional shape, and each terminal includes a curved cantilever contact piece 62, a core wire barrel 64 for crimping a core wire 112 of an insulated cable 110, and an insulation barrel 66 for crimping an insulation 114 on the rear side of the terminal body 60. Upper and lower terminals 16 are inserted into respective terminal holding recesses 44 from the side of the rear face 14B through respective terminal introduction passages 46 until their front ends (front faces) 16A abut respective front end faces (abutting portions) 44A of the terminal holding recesses 44 such that, in the terminal chamber 42, the contact pieces 62 of each of the corresponding upper and lower terminals 16 are opposed to each other with a prescribed gap in-between. When the insertion is completed, the front end 16A of each terminal 16 contacts the front end face 44A to thereby restrict the frontward movement of the terminal 16 with respect to the terminal holder 14, and a tip of the lance portion 50 comes into non-return engagement with a locking portion 68 formed as a rectangular opening defined in the terminal body 60 to thereby restrict the rearward movement of the terminal 16 with respect to the terminal holder 14. Moreover, the front end 16A of the terminal 16 and the front end face 44A of the terminal holding recess 44 come into engagement with each other by a projection and a recess to thereby restrict the upward and downward movement of the tip side of the terminal 16 with respect to the terminal holder 14.

In this way, the terminals 16 of respective sets of the upper and lower terminals 16 inside the terminal chamber 42 are arranged side by side at regular intervals so that the upper and lower terminals 16 are in alignment with each other in the left and right direction.

As shown in FIG. 6, the insulation barrel 66 and the insulated cable 110 extend out rearwardly from the outer shell 12 through a rear opening 36 formed in the rear part of the outer shell 12. A rear seal chamber 70 in communication with the rear opening 36 is formed in the rear part of the outer shell 12. Attached to the rear seal chamber 70 is the cable seal 120 which is formed of a rubber-like elastic material and has a through-hole 122, through which each insulated cable 110 is passed individually.

As shown in FIG. 6, the case receiving chamber 32 is located on the front side of the holder chamber 34 (i.e. on the side of the case inlet 30), and a waterproof seal 20 is provided within the case receiving chamber 32. The waterproof seal 20 is formed of a rubber-like elastic material having a flat annular shape (FIG. 1) that extends around an outer circumference surface of the packaging case 102 (see FIGS. 15 and 16). The waterproof seal 20 has an outer circumference surface 20A, which is closely attached to an inner circumferential surface 32A of the case receiving chamber 32 so that front ends of multiple annular lands 20B, which are formed on the inner periphery of the waterproof seal 20, are brought into close contact with the outer circumference surface of the packaging case 102 inserted in the case receiving chamber 32 to thereby provide a waterproof seal between the outer shell 12 and the controller unit 104.

On both the upper and lower surfaces of the terminal edge portion 100 of the double-sided printed board, multiple terminal parts (land portions) 106 (see FIGS. 15 and 16) are formed and located at the same regular intervals as the regular intervals at which the terminals 16 are arranged in the left and right direction. When the packaging case 102 is inserted into the case receiving chamber 32, the terminal edge portion 100 is inserted into the terminal chamber 42 so that the terminal parts 106 on the upper and lower surfaces are brought into contact with and electrically connected to the contact pieces 62 (see FIG. 6) on the upper and lower sides of the terminal 16.

Figure 2:
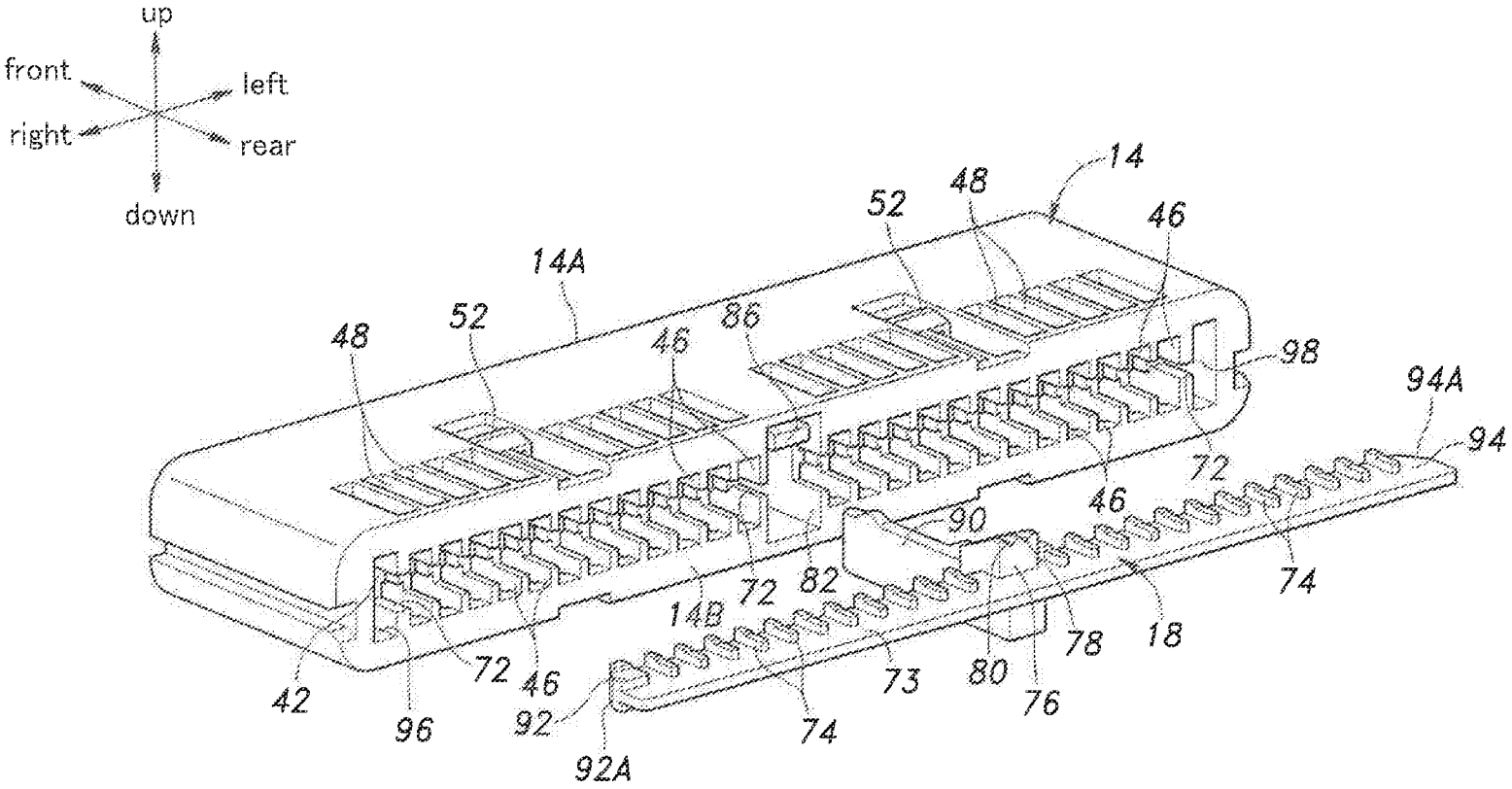
FIG. 2 is an exploded rear perspective view of a terminal holder and a side retainer of the connector according to the embodiment of the present invention.
Figure 3:
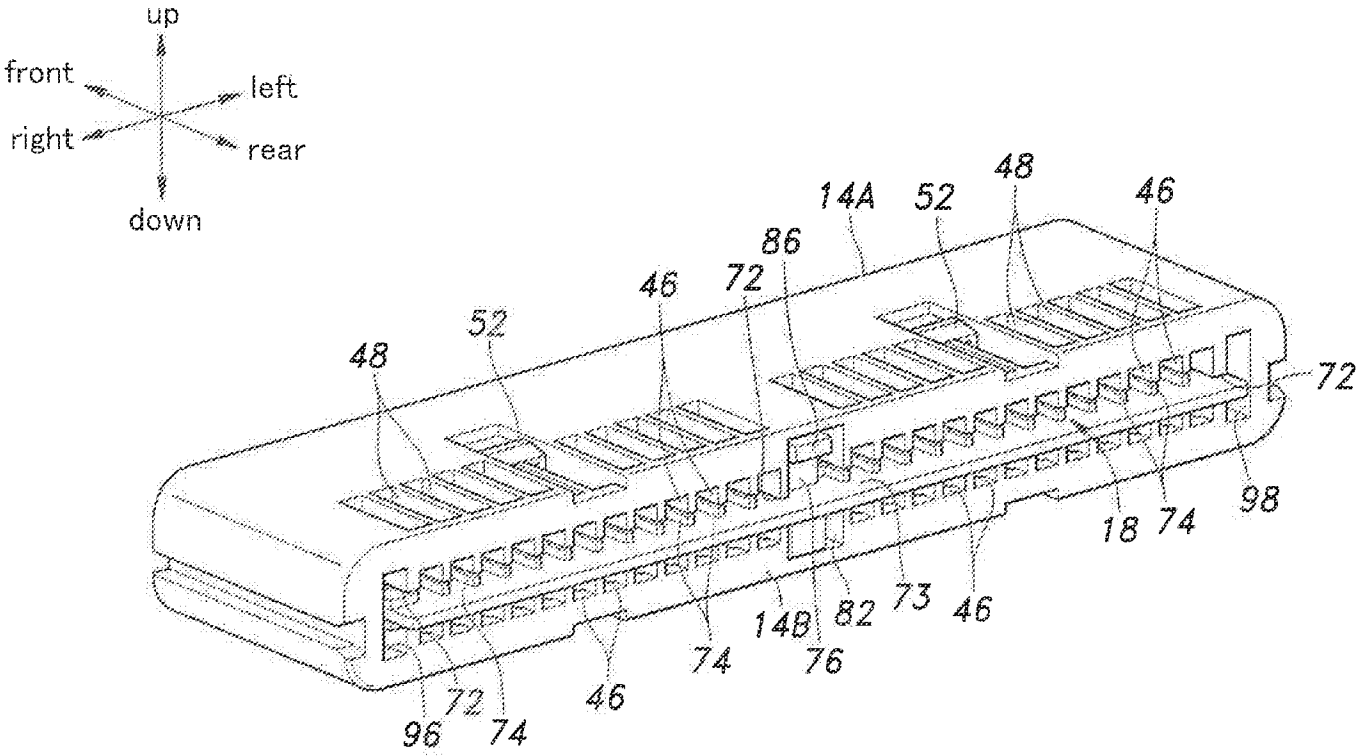
FIG. 3 is a rear perspective view of the terminal holder and the side retainer of the connector according to the embodiment of the present invention.

In a rear portion of the terminal holder 14, slits 72 opening on the rear face 14B are formed at multiple locations spaced apart in the left and right direction as shown in FIGS. 2 and 3.

As shown in FIGS. 1 to 6 and 8 to 10, the side retainer 18 is a resin molded part with a rectangular shape having a longitudinal axis extending in the left and right direction. In other words, the resin molded side retainer 18 includes a strip plate portion 73 having a longitudinal axis extending in a direction orthogonal to the direction in which the terminal 16 is inserted into the terminal holding recess 44. The side retainer 18 further includes multiple locking protrusions 74 formed on and protruding from the upper and lower sides of the strip plate portion 73 at the same regular intervals as those at which the terminals 16 are arranged.

The strip plate portion 73 is mounted in the terminal holder 14 such that the strip plate portion 73 engages with the slits 72 and is movable in the left and right direction. When the strip plate portion 73 is mounted in the terminal holder 14, the strip plate portion 73 extends across all the terminal introduction passages 46 between the upper and lower terminal introduction passages 46, and is movable between a lock position (first position) and an unlock position (second position) which is displaced from the lock position in the left and right direction (the direction across the terminal introduction passages 46). In other words, the side retainer 18 is supported by the terminal holder 14 in such a manner as to be movable between the lock position and the unlock position which is displaced in the direction orthogonal to the direction in which the terminal 16 is inserted into the terminal holding recess 44.

Figure 8:
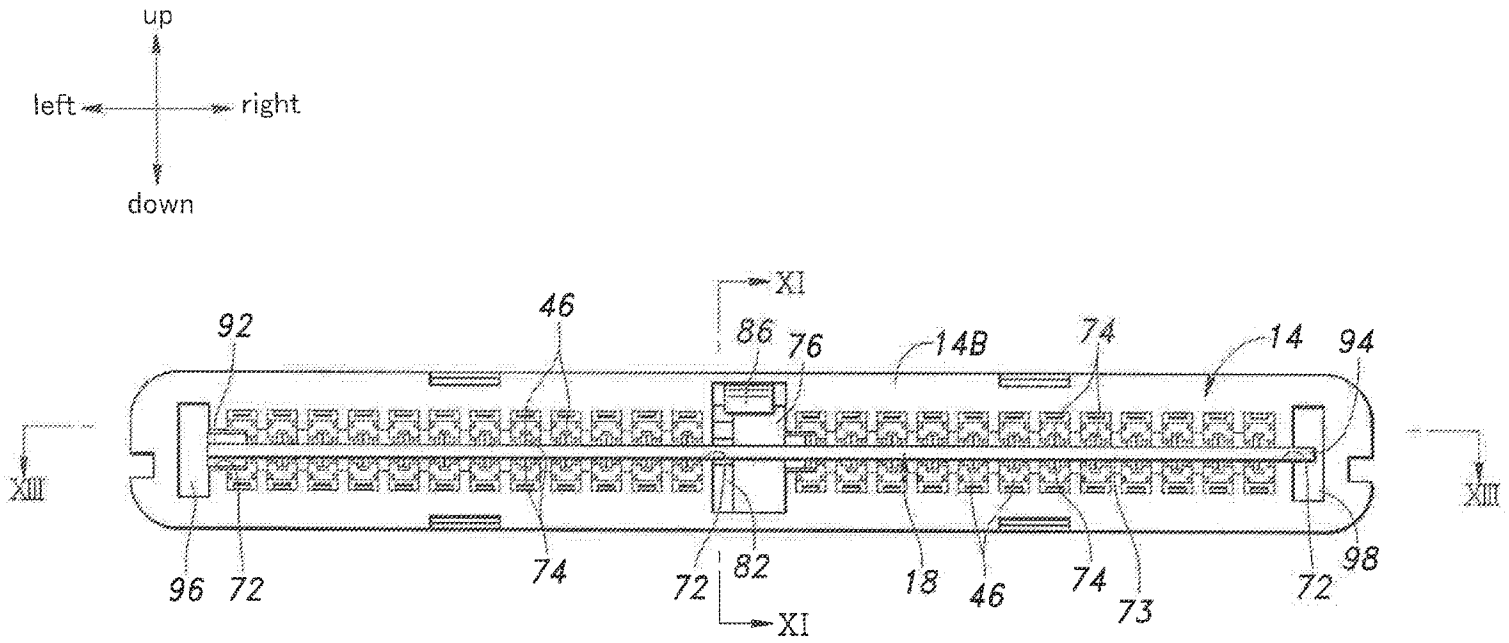
FIG. 8 is a front view of the terminal holder and the side retainer of the connector according to the embodiment of the present invention.
Figure 9:
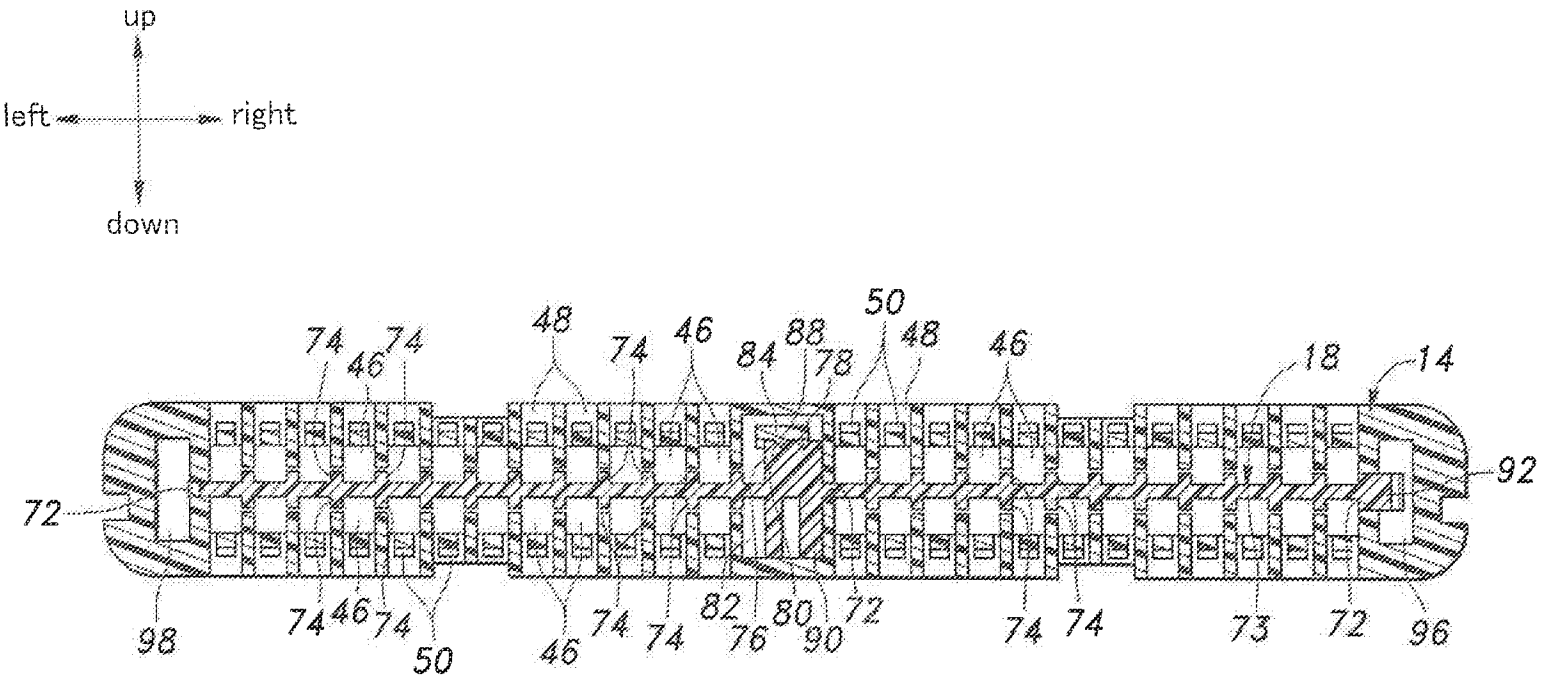
FIG. 9 is a cross-sectional view of the connector (where the side retainer is at the first position) taken along line IX-IX of FIG. 7.
Figure 10:
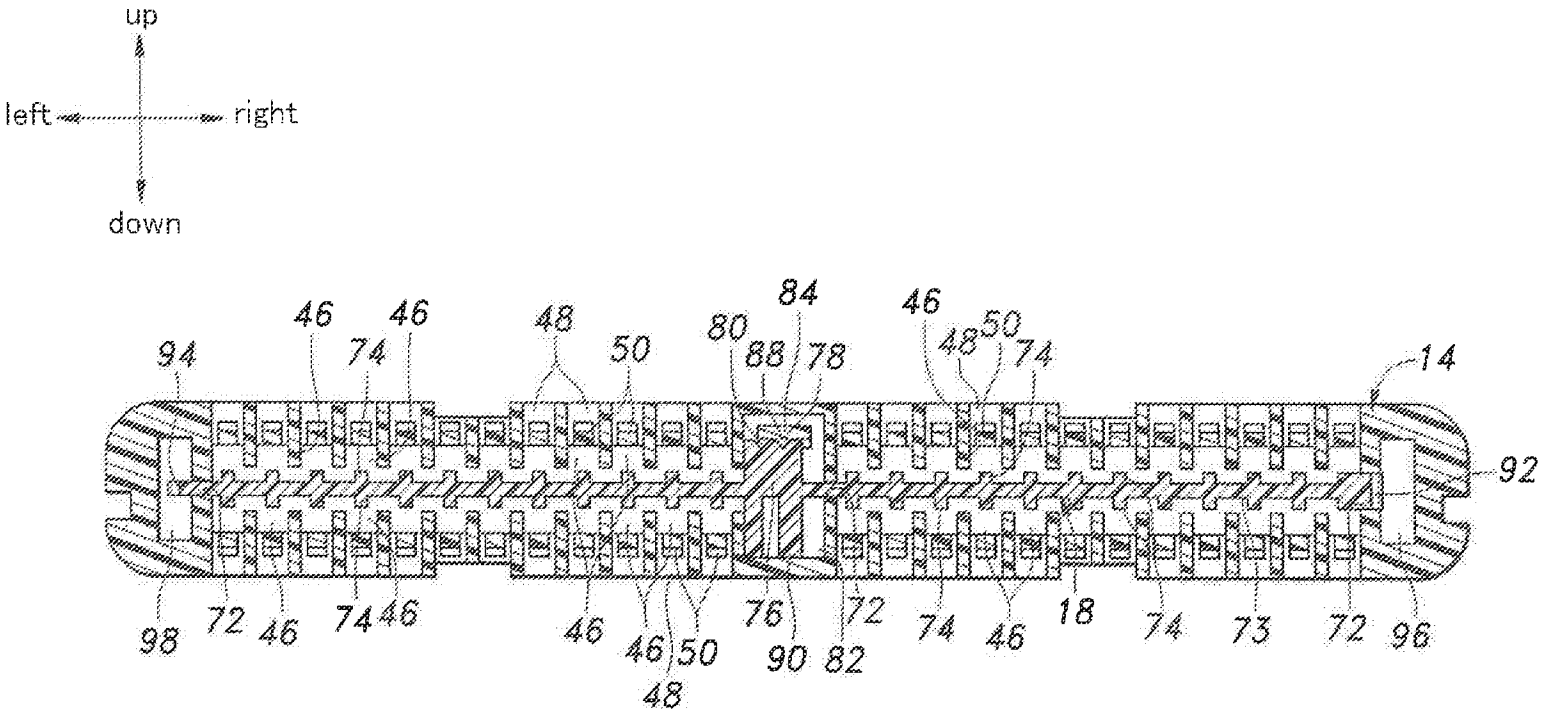
FIG. 10 is a cross-sectional view of the connector (where the side retainer is at the first position) taken along line IX-IX of FIG. 7.
Figure 11:
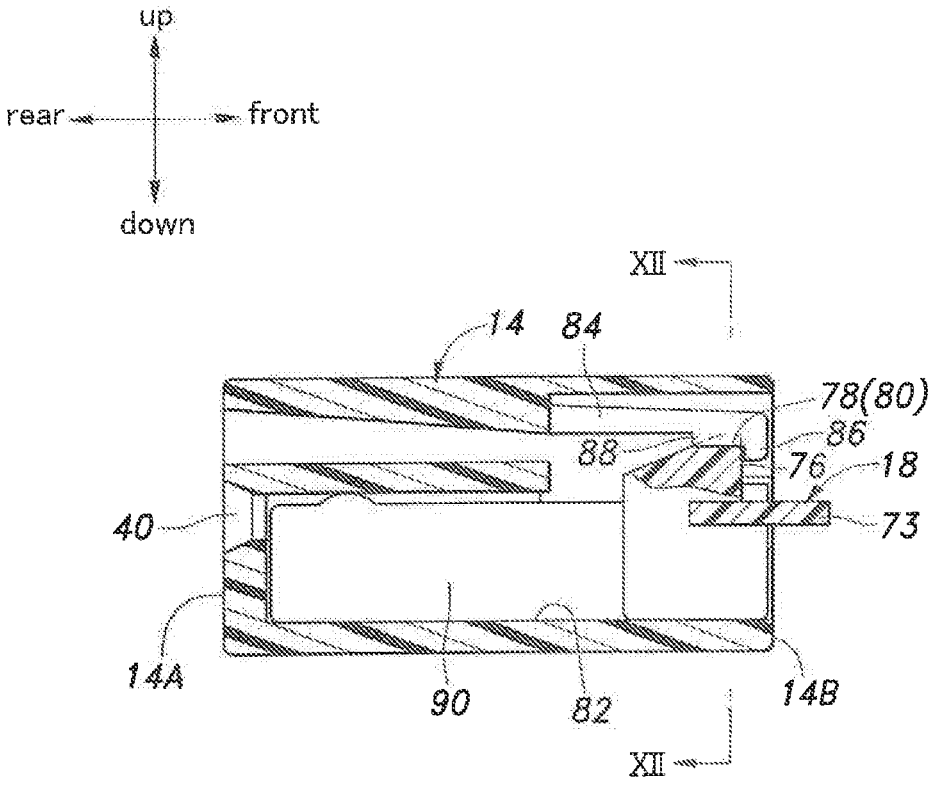
FIG. 11 is an enlarged cross-sectional view of the connector taken along line XI-XI of FIG. 8.

As shown in FIGS. 5, 8 and 10, when the strip plate portion is at the lock position, each locking protrusion 74 is located at a position in alignment with a corresponding terminal introduction passage 46 and opposes a shoulder 69 of the terminal body 60 (see FIGS. 5 and 6) so as to prevent a corresponding terminal 16 from coming off; that is, to prevent the rearward movement of the terminal 16 with respect to the terminal holder 14. As shown in FIGS. 3, 4 and 9, when the strip plate portion is at the unlock position, each locking protrusion 74 is located at an offset position with respect to a corresponding terminal introduction passage 46 or at a position between adjoining two terminal introduction passages 46 so as to allow a corresponding terminal 16 to be inserted into the terminal holding recess 44 through a terminal introduction passage 46; that is, to allow the terminal 16 to pass through the terminal introduction passage 46 to be placed in the terminal chamber 42.

As shown in FIGS. 1, 2, 13, and 14, retainer manipulation portions 92, 94 are integrally formed at both the left and right side ends of the strip plate portion 73. Each retainer manipulation portion 92 or 94 has an inclined cam surface 92A, 94A on the front side. The inclined cam surfaces 92A, 94A convert a displacement in the front and rear direction (a direction in which access passages 96, 98 extend as described later) to a movement of the side retainer in the left and right direction (a direction traversing the terminal introduction passages 46).

As shown in FIGS. 8 to 10, 13 and 14, the access passages 96 and 98 are formed on the left and right side ends of the terminal holder 14. The access passages 96 and 98 are openings extending through the terminal holder 14 in the front and rear direction from the front face 14A of the terminal holder 14, on which the edge inlet 40 opens, to the inclined cam surface 92A and 94A. When the side retainer 18 is manipulated, a rod-like tool (jig) 130 is inserted from the side of the edge inlet 40. The rod-like tool 130 may be a simple rod, and preferably a rod member having an inclined front end face 130A.

Figure 13:
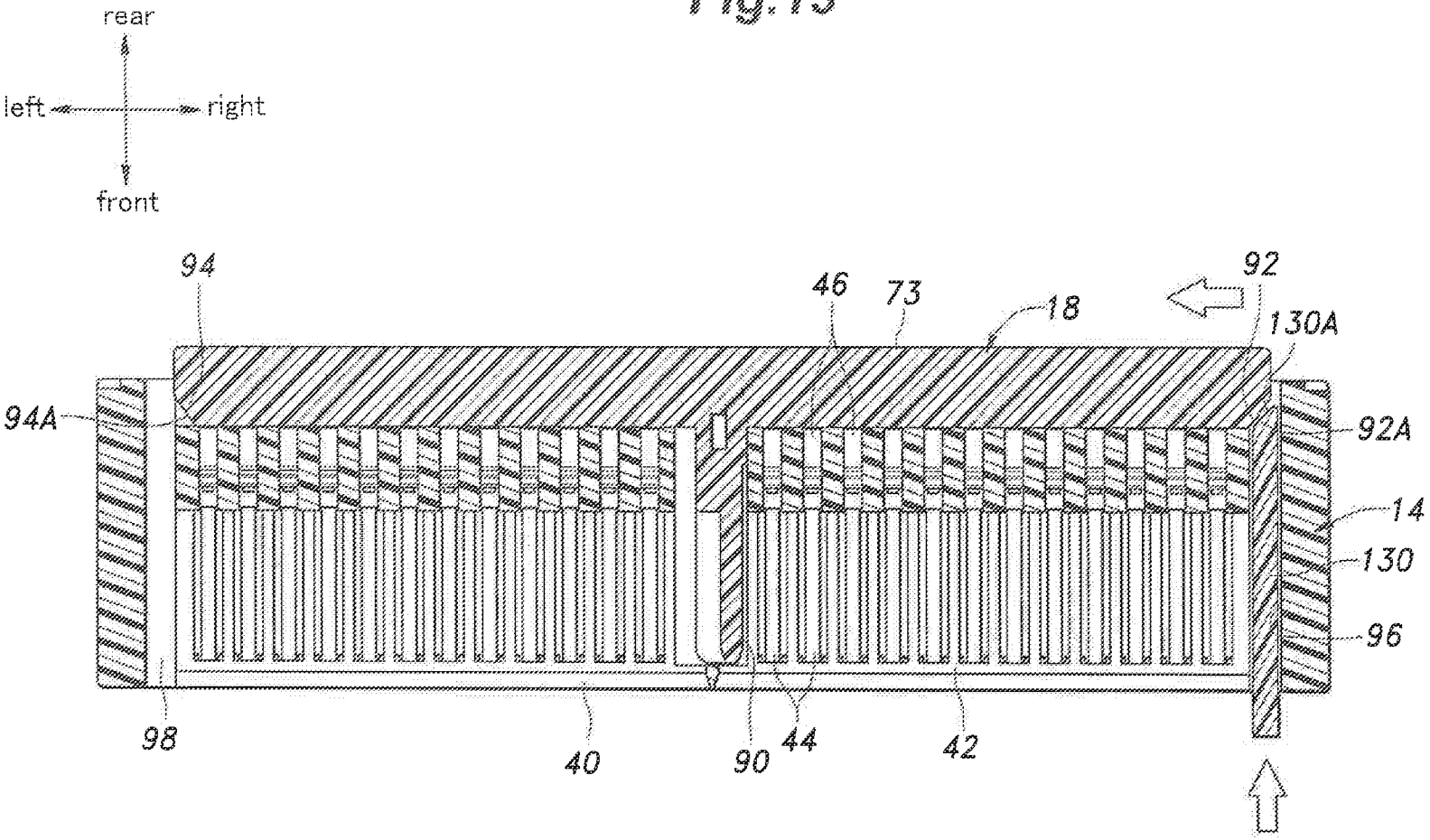
FIG. 13 is a cross-sectional view of the connector (where the side retainer is at the first position) taken along line XIII-XIII of FIG. 8.

As shown in FIG. 13, when the side retainer 18 is at the unlock position, the rod-like tool 130 is inserted into the right access passage 96 from the side of the edge inlet 40 so that the rearward movement of the rod-like tool 130 causes the inclined front end face 130A to push the inclined cam surface 92A, which in turn causes the side retainer 18 to move to the left. As a result, the side retainer 18 shifts into the lock position.

Figure 14:
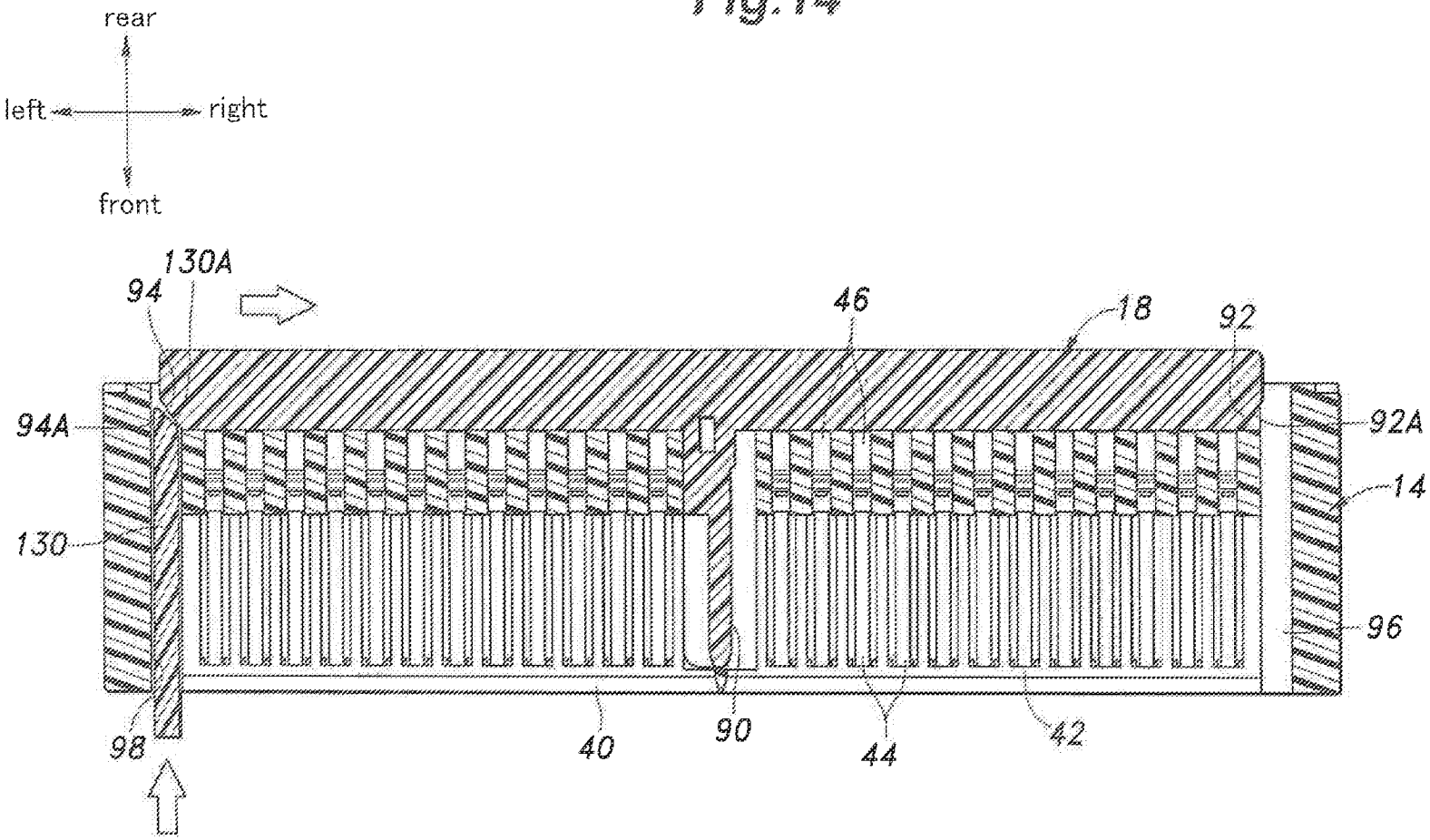
FIG. 14 is a cross-sectional view of the connector (where the side retainer is at the first position) taken along line XIV-XIV of FIG. 8.

As shown in FIG. 14, when the side retainer 18 is at the lock position, the rod-like tool 130 is inserted into the left access passage 98 from the side of the edge inlet 40 so that the rearward movement of the rod-like tool 130 causes the inclined front end face 130A to push the inclined cam surface 94A, which in turn causes the side retainer 18 to move to the right. As a result, the side retainer 18 shifts into the unlock position.

In this way, even if the side retainer 18 is placed within the terminal holder 14 and there is no opening for inserting and manipulating the side retainer 18 on a side of the terminal holder 14, the side retainer 18 can be shifted from the unlock position to the lock position, and vice versa, by the manipulation of the rod-like tool from the side of the edge inlet 40 of the terminal holder 14. Furthermore, even after the terminal holder 14 is accommodated in the outer shell 12, the side retainer 18 can be shifted from the unlock position to the lock position, and vice versa, by the manipulation of the rod-like tool from the side of the case inlet 30 of the outer shell 12.

Thus, even if the side retainer 18 is placed within the terminal holder 14, there is no need to form an opening for inserting and manipulating the side retainer 18 in the terminal holder 14 on a side of the terminal holder 14, which means that there is no need for any waterproof seal for such a side opening in addition to the waterproof seal 20. Furthermore, the connector can be made structurally simple because the side retainer 18 is made to be movable from or to the lock position or the unlock position through the manipulation from the side of edge inlet 40 only by providing the side retainer 18 with the inclined cam surfaces 92A, 94A on the both sides and using the simple rod-like tool 130 for manipulation.

As shown in FIGS. 1 to 3 and 8 to 12, block portions 76 protruding upward and downward of the strip plate portion 73 are integrally molded at the center of the strip plate portion 73 in the left-right direction. Left and right v-shaped grooves (recesses) 78, 80 are formed on an upper surface of the block portion 76. As shown in FIGS. 1 to 3 and 8 to 12, an opening 82 opening on the rear face 14B is defined at the center of the terminal holder 14 in the left and right direction. The terminal holder 14 is integrally formed with a cantilever locking piece 84 located within the opening 82. The locking piece 84 includes a barb 86 (see FIG. 11) which is engageable with a rear face of the block portion 76 to prevent the side retainer 18 from coming off, and a v-shaped protrusion (projection) 88 (see FIG. 12) which is selectively engageable with either one of the v-shaped grooves 78, 80.

Figure 12:
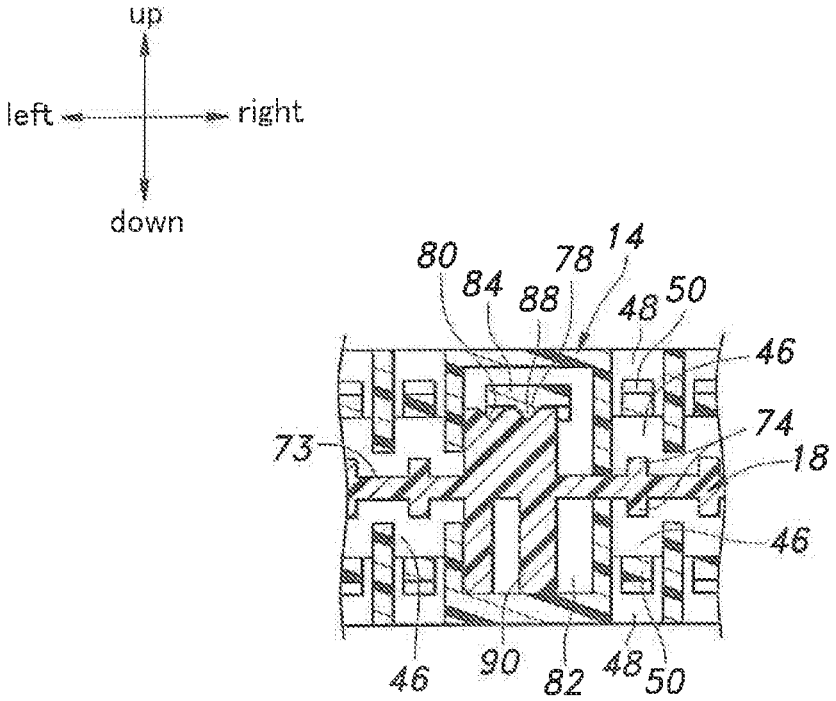
FIG. 12 is a cross-sectional view of the connector taken along line XII-XII of FIG. 11.

When the side retainer 18 is at the lock position, the v-shaped protrusion 88 engages with the v-shaped groove 78 as shown in FIGS. 10 and 12. When the side retainer 18 is at the unlock position, the v-shaped protrusion 88 engages with the v-shaped groove 80 as shown in FIG. 9. Thus, this structural feature serves as a click stop mechanism, which enables the side retainer 18 to stably maintain its position when the side retainer 18 is at the lock position or the unlock position.

Figure 15:
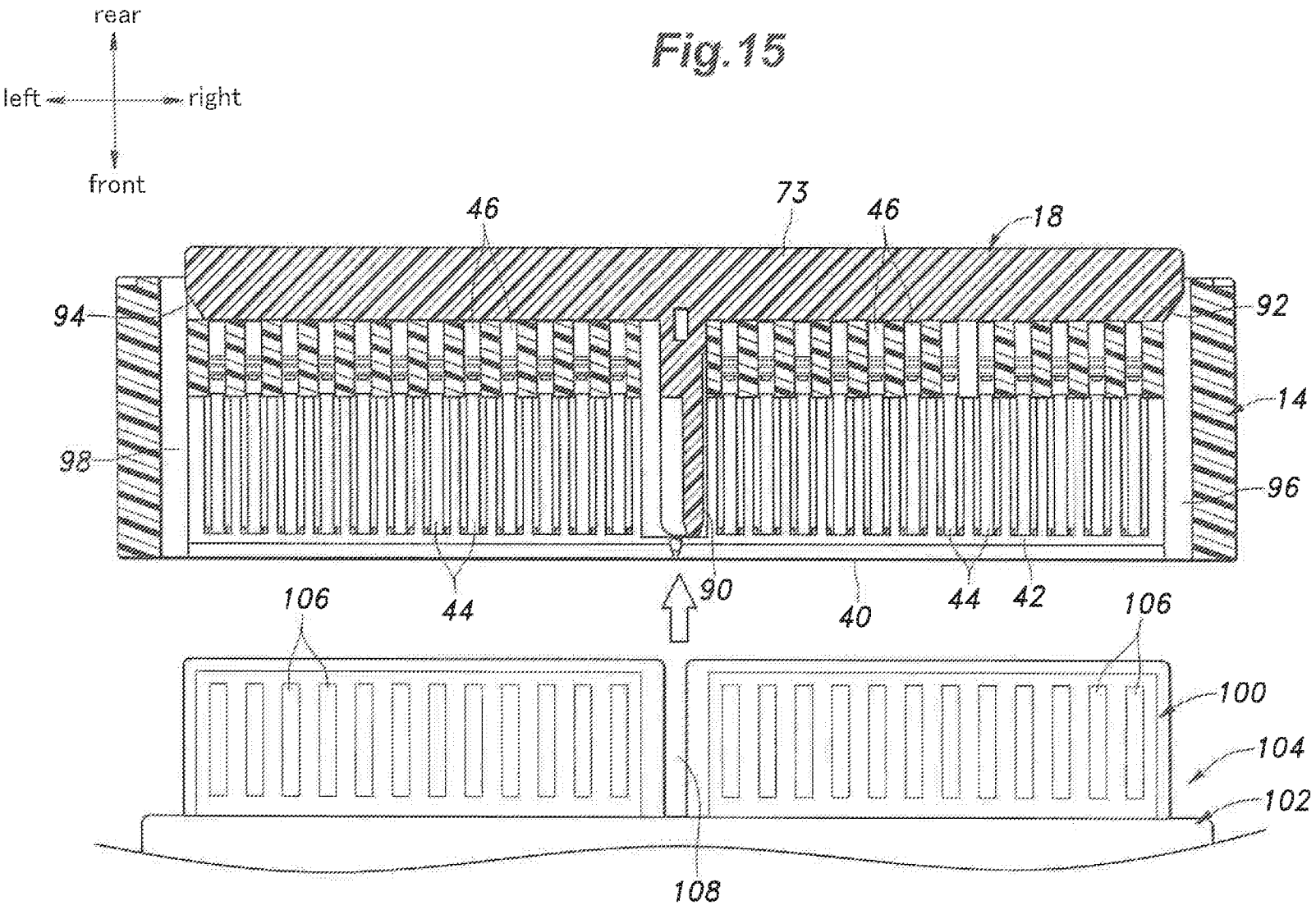
FIG. 15 is a cross-sectional view (taken along line XIV-XIV of FIG. 8) showing the relationship between the side retainer located at the first position and the terminal edge portion of a printed circuit board.
Figure 16:
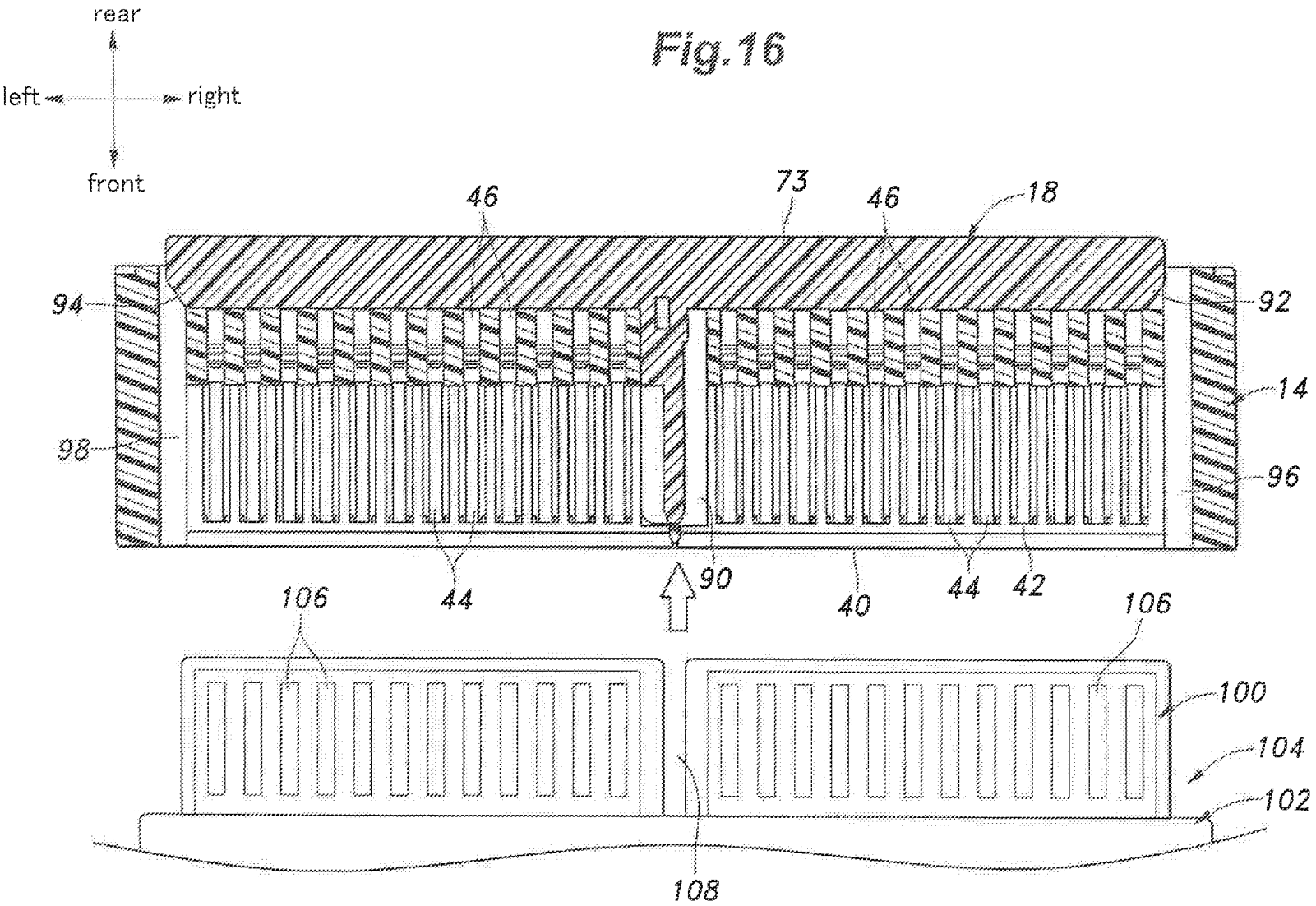
FIG. 16 is a cross-sectional view (taken along line XIV-XIV of FIG. 8) showing the relationship between the side retainer located at the second position and the terminal edge portion of a printed circuit board.

As shown in FIGS. 1, 2, 11, 15, and 16, a foolproof protruding part 90 is integrally molded at the center of the strip plate portion 73 in the left-right direction. The foolproof protruding part 90 extends out from the strip plate portion 73 so that the part 90 can be located in the opening 82 and extending towards the edge inlet 40. When the side retainer 18 is at the lock position, the foolproof protruding part 90 is in alignment with a slit 108 formed at the center of the terminal edge portion 100 in the left and right direction as shown in FIG. 16 to thereby allow the terminal edge portion 100 to enter the terminal chamber 42 without interfering with the terminal edge portion 100. When the side retainer 18 is at the unlock position, the foolproof protruding part 90 is not in alignment with the slit 108 as shown in FIG. 15 so that, when the terminal edge portion

100 is moving towards the terminal chamber 42, the foolproof protruding part 90 can interfere with a tip edge of the terminal edge portion 100 and thus serve as a fool proofing part for preventing the terminal edge portion 100 from entering the terminal chamber 42.

In this way, when the side retainer 18 is at the unlock position and thus does not prevent the terminal 16 from coming off, the terminal edge portion 100 is prevented from entering the terminal chamber 42 from the edge inlet 40, which means that the connectee member is prevented from connecting to the connector under inappropriate conditions for connection.

The present disclosure has been described with reference to the specific embodiment. However, as will be understood by those skilled in the art, the invention is not intended to be limited to the particular details disclosed, and may be modified as appropriate without departing from the scope of the invention. For example, connectors of the present invention are not limited to card edge connectors for printed boards, double-sided board connectors, and multiple connectors provided with multiple terminals 16, but may be connectors with connectee members other than those for printed board terminal edges, such as connectors with jack plugs and receptacles. A member used as the fool proofing part may be any abutting member configured such that, when the side retainer 18 is at the lock position, the member allows the connectee member to enter the terminal chamber 42 without interfering with the connectee member, whereas, when the side retainer 18 is at the unlock position, the side retainer can interfere with the connectee member so as to prevent the connectee member from entering the terminal chamber 42. All elements of the embodiment as described above are not necessarily essential, and one or more of them can be eliminated or selected as appropriate without departing from the scope of the present invention.

Glossary

10 connector
12 outer shell
12A front face
12B inner-rear face
14 terminal holder
14A front face
14B rear face
16 terminal
16A front end
18 side retainer
20 waterproof seal
20A outer circumference surface
20B annular land
30 case inlet
32 case receiving chamber
32A inner circumferential surface
34 holder chamber
36 rear opening
40 edge inlet
42 terminal chamber
44 terminal holding recess
44A front end face
46 terminal introduction passage
48 opening
50 lance portion
52 locking claw
60 terminal body
62 contact piece
64 core wire barrel
66 insulation barrel
68 locking portion
69 shoulder
70 rear seal chamber
72 slit
73 strip plate portion
74 locking protrusion
76 block portion
78 v-shaped groove
80 v-shaped groove
82 opening
84 locking piece
86 barb
88 v-shaped protrusion
90 foolproof protruding part
92 retainer manipulation portion
92A inclined cam surface
94 retainer manipulation portion
94A inclined cam surface
96 access passage
98 access passage
100 terminal edge portion (connectee member)
102 packaging case
104 controller unit
106 terminal part
108 slit
110 insulated cable
112 core wire
114 insulation
120 cable seal
122 through-hole
130 rod-like tool
130A inclined front end face

The invention claimed is:

1. A connector comprising:

a terminal holder having an inlet on a first side thereof for a connectee member, the terminal holder defining a terminal chamber continuous to the inlet and a terminal introduction passage in communication with the terminal chamber and extending from a second side remote from the first side of the terminal holder;

at least one terminal attached to the terminal holder so as to be located in the terminal chamber; and a side retainer mounted in the terminal holder in such a manner as to be movable between a first position and a second position spaced apart from the first position in a direction transverse to the terminal introduction passage, wherein the side retainer includes at least one locking protrusion configured such that, when the side retainer is at the first position, the at least one locking protrusion is in alignment with the terminal introduction passage and prevents the at least one terminal from coming off, and that, when the side retainer is at the second position, the at least one locking protrusion is offset from the terminal introduction passage so as to allow the at least one terminal to pass through the terminal introduction passage to be placed in the terminal chamber, wherein the terminal holder defines two access passages configured to allow a tool to be inserted into one of the two access passages from the first side so as to reach a part of the side retainer so that the side retainer is moveable between the first and second positions, and wherein the side retainer has retainer manipulation portions including inclined cam surfaces, each inclined cam surface being configured to convert a displacement of the tool in a direction in which the one of the two access passages extends to a movement of the side retainer in a direction traversing the terminal introduction passage, and wherein the two access passages extend to provide an access to a corresponding inclined cam surface.

2. The connector according to claim 1, further comprising:

an outer shell defining a holder chamber configured to accommodate the terminal holder; and an annular seal attached to the outer shell to provide a waterproof seal between the connectee member and the outer shell.

3. The connector according to claim 1, wherein the terminal includes a plurality of terminals arranged side by side at regular intervals and in alignment with each other in an alignment direction, wherein the side retainer includes a strip plate portion having a longitudinal axis extending in the alignment direction of the plurality of terminals, and wherein the side retainer includes two or more locking protrusions such that each of the plurality of terminals has one corresponding locking protrusion, and the locking protrusions are formed on a plate surface of the strip plate portion at the same regular intervals as those at which the terminals are arranged.

4. The connector according to claim 1, wherein one of the side retainer and the terminal holder has a projection formed thereon and the other of the side retainer and the terminal holder has a recess formed thereon, the recess and the projection being configured to engage with each other when the side retainer is at the first position or the second position.

5. An assembly comprising the connector according to claim 1 and a connectee, wherein the side retainer includes a fool proofing part configured such that, when the side retainer is at the second position, the fool proofing part is capable of interfering with the connectee member to prevent the connectee member from entering the terminal chamber, and that, when the side retainer is at the first position, the fool proofing part allows the connectee member to enter the terminal chamber without interfering with the terminal edge portion.

* * * * *